US005755835A

United States Patent [19]

Cherpeck

[11] Patent Number: 5,755,835

[45] Date of Patent: May 26, 1998

[54] FUEL ADDITIVE COMPOSITIONS CONTAINING ALIPHATIC AMINES AND POLYALKYL HYDROXYAROMATICS

[75] Inventor: Richard E. Cherpeck, Cotati, Calif.

[73] Assignee: Chevron Chemical Company, San Ramon, Calif.

[21] Appl. No.: 997,981

[22] Filed: Dec. 28, 1992

[51] Int. Cl.[6] ..... C10L 1/22

[52] U.S. Cl. ..... 44/432; 44/442

[58] Field of Search ..... 44/412, 434, 347, 44/433, 450, 432, 442

[56] References Cited

U.S. PATENT DOCUMENTS

| | | | |
|---|---|---|---|
| 3,438,757 | 4/1969 | Honnen et al. | 44/433 |
| 3,443,918 | 5/1969 | Kautsky et al. | 44/347 |
| 3,849,085 | 11/1974 | Kreuz et al. | 44/450 |
| 4,014,663 | 3/1977 | Feldman et al. | 44/442 |
| 4,123,232 | 10/1978 | Frost, Jr. | 44/434 |
| 4,134,846 | 1/1979 | Machleder et al. | 252/51.5 |
| 4,191,537 | 3/1980 | Lewis et al. | 44/334 |
| 4,231,759 | 11/1980 | Udelhofen et al. | 44/75 |
| 4,247,301 | 1/1981 | Honnen | 44/334 |
| 4,708,809 | 11/1987 | Davis | 252/33.4 |
| 4,832,702 | 5/1989 | Kummer et al. | 44/412 |
| 5,114,435 | 5/1992 | Abrams et al. | 44/347 |
| 5,192,335 | 3/1993 | Cherpeck | 44/450 |

FOREIGN PATENT DOCUMENTS

| | | | |
|---|---|---|---|
| 2528065 | 12/1983 | France | C10M 1/20 |
| 2156848 | 10/1985 | United Kingdom | C10L 1/14 |
| WO 93/19140 | 9/1993 | WIPO | C10L 1/22 |

*Primary Examiner*—Jerry D. Johnson
*Attorney, Agent, or Firm*—Claude J. Caroli

[57] ABSTRACT

A fuel additive composition comprising:

(a) A fuel-soluble aliphatic amine selected from the group consisting of (1) a straight or branched chain hydrocarbyl-substituted amine, (2) a hydroxyalkyl substituted amine, and (3) a straight or branched chain hydrocarbyl-substituted succinimide; and (b) a polyalkyl hydroxyaromatic compound or salt thereof wherein the polyalkyl group has sufficient molecular weight and carbon chain length to render the polyalkyl hydroxyaromatic compound soluble in hydrocarbons boiling in the gasoline or diesel range.

4 Claims, No Drawings

FUEL ADDITIVE COMPOSITIONS CONTAINING ALIPHATIC AMINES AND POLYALKYL HYDROXYAROMATICS

BACKGROUND OF THE INVENTION

This invention relates to a fuel additive composition. More particularly, this invention relates to a fuel additive composition containing an aliphatic amine and a polyalkyl hydroxyaromatic compound.

It is well known in the art that liquid hydrocarbon combustion fuels, such as fuel oils and gasolines, tend to exhibit certain deleterious characteristics, either after long periods of storage or under actual operational conditions. Gasolines, for example, in operational use tend to deposit sludge and varnish at various points in the power system, including the carburetor or injectors and the intake valves. It is desirable, therefore, to find a means for improving liquid hydrocarbon fuels by lessening their tendency to leave such deposits.

U.S. Pat. No. 3,849,085 discloses a motor fuel composition comprising a mixture of hydrocarbon in the gasoline boiling range containing about 0.01 to 0.25 volume percent of a high molecular weight aliphatic hydrocarbon substituted phenol in which the aliphatic hydrocarbon radical has an average molecular weight in the range of about 500 to 3,500. This patent teaches that gasoline compositions containing a minor amount of an aliphatic hydrocarbon substituted phenol not only prevents or inhibits the formation of intake valve and port deposits in a gasoline engine but also enhances the performance of the fuel composition in engines designed to operate at higher operating temperatures with a minimum of decomposition and deposit formation in the manifold of the engine.

U.S. Pat. No. 4,134,846 discloses a fuel additive composition comprising a mixture of (1) the reaction product of an aliphatic hydrocarbon-substituted phenol, epichlorohydrin and a primary or secondary mono- or polyamine, and (2) a polyalkylene phenol. This patent teaches that such compositions show excellent carburetor, induction system and combustion chamber detergency and, in addition, provide effective rust inhibition when used in hydrocarbon fuels at low concentrations.

U.S. Pat. No. 4,231,759 discloses a fuel additive composition comprising the Mannich condensation product of (1) a high molecular weight sulfur-free alkyl-substituted hydroxyaromatic compound wherein the alkyl group has a number average molecular weight of about 600 to 3,000 (2) an amine containing at least one active hydrogen atom, and (3) an aldehyde, wherein the respective molar ratio of reactants is 1:0.1–10:0.1–10.

SUMMARY OF THE INVENTION

The present invention provides a novel fuel additive composition comprising:

(a) a fuel-soluble aliphatic amine selected from the group consisting of:

(1) a straight or branched chain hydrocarbyl-substituted amine having at least one basic nitrogen atom wherein the hydrocarbyl group has a number average molecular weight of about 250 to 3,000, (2) a hydroxyalkyl-substituted amine comprising the reaction product of (i) a polyolefin epoxide derived from a branched-chain polyolefin having a number average molecular weight of about 250 to 3,000, and (ii) a nitrogen-containing compound selected from ammonia, a monoamine having from 1 to 40 carbon atoms, and a polyamine having from 2 to about 12 amine nitrogen atoms and from 2 to about 40 carbon atoms, and (3) a straight or branched chain hydrocarbyl-substituted succinimide comprising the reaction product of a straight or branched chain hydrocarbyl-substituted succinic acid or anhydride, wherein the hydrocarbyl group has a number average molecular weight of about 250 to 3,000, and a polyamine having from 2 to about 12 amine nitrogen atoms and 2 to about 40 carbon atoms; and (b) a polyalkyl hydroxyaromatic compound or salt thereof wherein the polyalkyl group has sufficient molecular weight and carbon chain length to render the polyalkyl hydroxyaromatic compound soluble in hydrocarbons boiling in the gasoline or diesel range.

The present invention further provides a fuel composition comprising a major amount of hydrocarbons boiling in the gasoline or diesel range and an effective detergent amount of the novel fuel additive composition described above.

The present invention is also concerned with a fuel concentrate comprising an inert stable oleophilic organic solvent boiling in the range of from about 150° F. to 400° F. and from about 10 to 70 weight percent of the fuel additive composition of the instant invention.

Among other factors, the present invention is based on the surprising discovery that the unique combination of an aliphatic amine and a polyalkyl hydroxyaromatic compound provides unexpectedly superior deposit control performance when compared to each component individually.

DETAILED DESCRIPTION OF THE INVENTION

The Aliphatic Amine

As noted above, the fuel-soluble aliphatic amine component of the present fuel additive composition is an amine selected from the group consisting of a straight or branched chain hydrocarbyl-substituted amine, a hydroxyalkyl-substituted amine and a hydrocarbyl-substituted succinimide. Preferably, such aliphatic amines will be of sufficient molecular weight so as to be nonvolatile at normal engine intake valve operating temperatures, which are generally in the range of about 175° C. to 300°.

A. The Hydrocarbyl-Substituted Amine

The hydrocarbyl-substituted amine employed as the aliphatic amine component of the present fuel additive composition is a straight or branched chain hydrocarbyl-substituted amine having at least one basic nitrogen atom wherein the hydrocarbyl group has a number average molecular weight of about 250 to 3,000.

Preferably, the hydrocarbyl group will have a number average molecular weight in the range of about 700 to 2,200, and more preferably, in the range of about 900 to 1,500. The hydrocarbyl group may be either straight chain or branched chain. When the hydrocarbyl group is straight chain, a preferred aliphatic amine is oleyl amine.

When employing a branched chain hydrocarbyl amine, the hydrocarbyl group is preferably derived from polymers of $C_2$ to $C_6$ olefins. Such branched-chain hydrocarbyl group will ordinarily be prepared by polymerizing olefins of from 2 to 6 carbon atoms (ethylene being copolymerized with another olefin so as to provide a branched-chain). The branched chain hydrocarbyl group will generally have at least 1 branch per 6 carbon atoms along the chain, preferably at least 1 branch per 4 carbon atoms along the chain and, more preferably, at least 1 branch per 2 carbon atoms along the chain. The preferred branched-chain hydrocarbyl groups are polypropylene and polyisobutylene. The branches will usually be of from 1 to 2 carbon atoms, preferably 1 carbon atom, that is, methyl. In general, the branched-chain hydrocarbyl group will contain from about 18 to about 214 carbon atoms, preferably from about 50 to about 157 carbon atoms.

In most instances, the branched-chain hydrocarbyl amines are not a pure single product, but rather a mixture of compounds having an average molecular weight. Usually, the range of molecular weights will be relatively narrow and peaked near the indicated molecular weight.

The amine component of the branched-chain hydrocarbyl amines may be derived from ammonia, a monoamine or a polyamine.

The monoamine or polyamine component embodies a broad class of amines having from 1 to about 12 amine nitrogen atoms and from 1 to 40 carbon atoms with a carbon to nitrogen ratio between about 1:1 and 10:1. Generally, the monoamine will contain from 1 to about 40 carbon atoms and the polyamine will contain from 2 to about 12 amine nitrogen atoms and from 2 to about 40 carbon atoms. In most instances, the amine component is not a pure single product, but rather a mixture of compounds having a major quantity of the designated amine. For the more complicated polyamines, the compositions will be a mixture of amines having as the major product the compound indicated and having minor amounts of analogous compounds. Suitable monoamines and polyamines are described more fully below in the discussion of hydroxyalkyl-substituted amines.

When the amine component is a polyamine, it will preferably be a polyalkylene polyamine, including alkylenediamine. Preferably, the alkylene group will contain from 2 to 6 carbon atoms, more preferably from 2 to 3 carbon atoms. Examples of such polyamines include ethylene diamine, diethylene triamine, triethylene tetramine and tetraethylene pentamine. Preferred polyamines are ethylene diamine and diethylene triamine.

A particularly preferred branched-chain hydrocarbyl amine is polyisobutenyl ethylene diamine.

The branched-chain hydrocarbyl amines employed in the fuel additive composition of the invention are prepared by conventional procedures known in the art. Such branched-chain hydrocarbyl amines and their preparations are described in detail in U.S. Pat. Nos. 3,438,757; 3,565,804; 3,574,576; 3,848,056 and 3,960,515, the disclosures of which are incorporated herein by reference.

B. The Hydroxyalkyl-Substituted Amine

The hydroxyalkyl-substituted amine additive employed in the fuel composition of the present invention comprises the reaction product of (a) a polyolefin epoxide derived from a branched chain polyolefin having an average molecular weight of about 250 to 3,000 and (b) a nitrogen-containing compound selected from ammonia, a monoamine having from 1 to 40 carbon atoms, and a polyamine having from 2 to about 12 amine nitrogen atoms and from 2 to about 40 carbon atoms. The amine component of this reaction product is selected to provide solubility in the fuel composition and deposit control activity.

Polyolefin Epoxide Component

The polyolefin epoxide component of the presently employed hydroxyalkyl-substituted amine reaction product is obtained by oxidizing a polyolefin with an oxidizing agent to give an alkylene oxide, or epoxide, in which the oxirane ring is derived from oxidation of the double bond in the polyolefin.

The polyolefin starting material used in the preparation of the polyolefin epoxide is a high molecular weight branched chain polyolefin having an average molecular weight of about 250 to 3,000, preferably from about 700 to 2,200, and more preferably from about 900 to 1,500.

Such high molecular weight polyolefins are generally mixtures of molecules having different molecular weights and can have at least one branch per 6 carbon atoms along the chain, preferably at least one branch per 4 carbon atoms along the chain, and particularly preferred that there be about one branch per 2 carbon atoms along the chain. These branched chain olefins may conveniently comprise polyolefins prepared by the polymerization of olefins of from 2 to 6 carbon atoms, and preferably from olefins of from 3 to 4 carbon atoms, and more preferably from propylene or isobutylene. When ethylene is employed, it will normally be copolymerized with another olefin so as to provide a branched chain polyolefin. The addition-polymerizable olefins employed are normally 1-olefins. The branch may be of from 1 to 4 carbon atoms, more usually of from 1 to 2 carbon atoms, and preferably methyl.

In general, any high molecular weight branched chain polyolefin isomer whose epoxide is capable of reacting with an amine is suitable for use in preparing the presently employed fuel additives. However, sterically hindered epoxides, such as tetra-alkyl substituted epoxides, are generally slower to react.

Particularly preferred polyolefins are those containing an alkylvinylidene isomer present in an amount at least about 20%, and preferably at least 50%, of the total polyolefin composition. The preferred alkylvinylidene isomers include methylvinylidene and ethylvinylidene, more preferably the methylvinylidene isomer.

The especially preferred high molecular weight polyolefins used to prepare the instant polyolefin epoxides are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 30, a polyisobutene having a molecular weight of about 1300 and a methylvinylidene content of about 76%, available from British Petroleum.

As noted above, the polyolefin is oxidized with a suitable oxidizing agent to provide an alkylene oxide, or polyolefin epoxide, in which the oxirane ring is formed from oxidation of the polyolefin double bond.

The oxidizing agent employed may be any of the well known conventional oxidizing agents used to oxidize double bonds. Suitable oxidizing agents include hydrogen peroxide, peracetic acid, perbenzoic acid, performic acid, monoperphthalic acid, percamphoric acid, persuccinic acid and petrifluoroacetic acid. The preferred oxidizing agent is peracetic acid.

When peracetic acid is used as the oxidizing agent, generally a 40% peracetic acid solution and about a 5% equivalent of sodium acetate (as compared to the peracetic acid) is added to the polyolefin in a molar ratio of peracid to olefin in the range of about 1.5:1 to 1:1, preferably about 1.2:1. The mixture is gradually allowed to react at a temperature in the range of about 20° C. to 90° C.

The resulting polyolefin epoxide, which is isolated by conventional techniques, is generally a liquid or semi-solid resin at room temperature, depending on the type and molecular weight of olefin employed.

Amine Component

The amine component of the presently employed hydroxyalkyl-substituted amine reaction product is derived from a nitrogen-containing compound selected from ammonia, a monoamine having from 1 to 40 carbon atoms, and a polyamine having from 2 to about 12 amine nitrogen atoms and from 2 to about 40 carbon atoms. The amine component is reacted with a polyolefin epoxide to produce the hydroxyalkyl-substituted amine fuel additive finding use within the scope of the present invention. The amine component provides a reaction product with, on the average, at least about one basic nitrogen atom per product molecule, i.e., a nitrogen atom titratable by a strong acid.

Preferably, the amine component is derived from a polyamine having from 2 to about 12 amine nitrogen atoms and from 2 to about 40 carbon atoms. The polyamine preferably has a carbon-to-nitrogen ratio of from about 1:1 to 10:1.

The polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

Hydrocarbyl, as used in describing the amine components of this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (C) are such as propionyl, acetyl, etc. The more preferred substituents are hydrogen, $C_1$–$C_6$ alkyls and C1–C6 hydroxyalkyls.

In a substituted polyamine, the substituents are found at any atom capable of receiving them. The substituted atoms, e.g., substituted nitrogen atoms, are generally geometrically unequivalent, and consequently the substituted amines finding use in the present invention can be mixtures of mono- and poly-substituted polyamines with substituent groups situated at equivalent and/or unequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene) triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the $C_2$–$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. A particularly preferred polyalkylene polyamine is diethylene triamine.

The amine component of the presently employed fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (A), (B), (C) and (D). The heterocyclic compounds are exemplified by piperazines, such as 2-methylpiperazine, N-(2-hydroxyethyl) -piperazine, 1,2-bis-(N-piperazinyl) ethane and N,N'-bis (N-piperazinyl)piperazine, 2-methylimidazoline, 3-aminopiperidine, 3-aminopyridine, N-(3-aminopropyl)-morpoline, etc. Among the heterocyclic compounds the piperazines are preferred.

Typical polyamines that can be used to form the additives employed in this invention by reaction with a polyolefin epoxide include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl) piperadine, 3-amino-N-ethylpiperidine, N-(beta-aminoethyl) morpholine, N,N'-di(beta-aminoethyl) piperazine, N,N'-di(beta-aminoethyl)imidazolidone-2, N-(beta-cyanoethyl) ethane-1,2-diamine, 1-amino-3,6,9-triazaoctadecane, 1-amino-3,6-diaza-9-oxadecane, N-(beta-aminoethyl) diethanolamine, N'acetylmethyl-N-(beta-aminoethyl) ethane-1,2-diamine, N-acetonyl-1,2-propanediamine, N-(beta-nitroethyl) -1,3-propane diamine, 1,3-dimethyl-5(beta-aminoethyl) hexahydrotriazine, N-(beta-aminoethyl)-hexahydrotriazine, 5-(beta-aminoethyl)-1,3,5-dioxazine, 2-(2-aminoethylamino) ethanol, and 2-[2-(2-aminoethylamino) ethylamino] ethanol.

Alternatively, the amine component of the presently employed hydroxyalkyl-substituted amine may be derived from an amine having the formula:

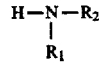

wherein $R_1$ and $R_2$ are independently selected from the group consisting of hydrogen and hydrocarbyl of 1 to about 20 carbon atoms and, when taken together, $R_1$ and $R_2$ may form one or more 5- or 6-membered rings containing up to about 20 carbon atoms. Preferably, $R_1$ is hydrogen and $R_2$ is a hydrocarbyl group having 1 to about 10 carbon atoms. More preferably, $R_1$ and $R_2$ are hydrogen. The hydrocarbyl groups may be straight-chain or branched and may be aliphatic, alicyclic, aromatic or combinations thereof. The hydrocarbyl groups may also contain one or more oxygen atoms.

An amine of the above formula is defined as a "secondary amine" when both $R_1$ and $R_2$ are hydrocarbyl. When $R_1$ is hydrogen and $R_2$ is hydrocarbyl, the amine is defined as a "primary amine"; and when both $R_1$ and $R_2$ are hydrogen, the amine is ammonia.

Primary amines useful in preparing the fuel additives of the present invention contain 1 nitrogen atom and 1 to about 20 carbon atoms, preferably 1 to 10 carbon atoms. The primary amine may also contain one or more oxygen atoms.

Preferably, the hydrocarbyl group of the primary amine is methyl, ethyl, propyl, butyl, pentyl, hexyl, octyl, 2-hydroxyethyl or 2-methoxyethyl. More preferably, the hydrocarbyl group is methyl, ethyl or propyl.

Typical primary amines are exemplified by N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-proponal, 2-(2-aminoethyoxy) ethanol, N-(2-methoxyethyl)amine, N-(2-ethoxyethyl)amine and the like. Preferred primary amines are N-methylamine, N-ethylamine and N-n-propylamine.

The amine component of the presently employed fuel additive may also be derived from a secondary amine. The hydrocarbyl groups of the secondary amine may be the same or different and will generally contain 1 to about 20 carbon atoms, preferably 1 to about 10 carbon atoms. One or both of the hydrocarbyl groups may also contain one or more oxygen atoms.

Preferably, the hydrocarbyl groups of the secondary amine are independently selected from the group consisting of methyl, ethyl, propyl, butyl, pentyl, hexyl, 2-hydroxyethyl and 2-methoxyethyl. More preferably, the hydrocarbyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di (propoxyethyl)amine and the like. Preferred secondary amines are N,N-dimethylamine, N,N-diethylamine and N,N-di-n-propylamine.

Cyclic secondary amines may also be employed to form the additives of this invention. In such cyclic compounds, $R_1$ and $R_2$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine and the like.

In many instances the amine component is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds of this invention using a polyamine, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99–116.

Preparation of the Hydroxyalkyl-Substituted Amine Reaction Product

As noted above, the fuel additive finding use in the present invention is a hydroxyalkyl-substituted amine which is the reaction product of (a) a polyolefin epoxide derived from a branched chain polyolefin having an average molecular weight of about 250 to 3,000 and (b) a nitrogen-containing compound selected from ammonia, a monoamine having from 1 to 40 carbon atoms, and a polyamine having from 2 to about 12 amine nitrogen atone and from 2 to about 40 carbon atoms.

The reaction of the polyolefin epoxide and the amine component is generally carried out either neat or with a solvent at a temperature in the range of about 100° C. to 250° C. and preferably from about 180° C. to about 220° C. A reaction pressure will generally be maintained in the range from about 1 to 250 atmospheres. The reaction pressure will vary depending on the reaction temperature, presence or absence of solvent and the boiling point of the amine component. The reaction usually is conducted in the absence of oxygen, and may be carried out in the presence or absence of a catalyst. The desired product may be obtained by water wash and stripping, usually by aid of vacuum, of any residual solvent.

The mole ratio of basic amine nitrogen to polyolefin epoxide will generally be in the range of about 3 to 50 moles of basic amine nitrogen per mole of epoxide, and more usually about 5 to 20 moles of basic amine nitrogen per mole of epoxide. The mole ratio will depend upon the particular amine and the desired ratio of epoxide to amine. Since suppression of polysubstitution of the amine is usually desired, large mole excesses of the amine will generally be used.

The reaction of polyolefin epoxide and amine may be conducted either in the presence or absence of a catalyst. When employed, suitable catalysts include Lewis acids, such as aluminum trichloride, boron trifluoride, titanium tetrachloride, ferric chloride, and the like. Other useful catalysts include solid catalysts containing both Brönsted and Lewis acid sites, such as alumina, silica, silica-alumina, and the like.

The reaction may also be carried out with or without the presence of a reaction solvent. A reaction solvent is generally employed whenever necessary to reduce the viscosity of the reaction product. These solvents should be stable and inert to the reactants and reaction product. Preferred solvents include aliphatic or aromatic hydrocarbons or aliphatic alcohols.

Depending on the temperature of the reaction, the particular polyolefin epoxide used, the mole ratios and the particular amine, as well as the presence or absence of a catalyst, the reaction time may vary from less than 1 hour to about 72 hours.

After the reaction has been carried out for a sufficient length of time, the reaction mixture may be subjected to extraction with a hydrocarbon-water or hydrocarbon-alcohol-water medium to free the product from any low-molecular weight amine salts which have formed and any unreacted polyamines. The product may then be isolated by evaporation of the solvent.

In most instances, the additive compositions used in this invention are not a pure single product, but rather a mixture of compounds having an average molecular weight.

Usually, the range of molecular weights will be relatively narrow and peaked near the indicated molecular weight. Similarly, for the more complicated amines, such as polyamines, the compositions will be a mixture of amines having as the major product the compound indicated as the average composition and having minor amounts of analogous compounds relatively close in compositions to the dominant compound.

C. The Hydrocarbyl-Substituted Succinimide

The hydrocarbyl-substituted succinimide which can be employed as the aliphatic amine component of the present fuel additive composition is a straight or branched chain hydrocarbyl-substituted succinimide comprising the reaction product of a straight or branched chain hydrocarbyl-substituted succinic acid or anhydride, wherein the hydrocarbyl group has a number average molecular weight of about 250 to 3,000, and a polyamine having from 2 to about 12 amine nitrogen atoms and 2 to about 40 carbon atoms.

Preferably, the hydrocarbyl group will have a number average molecular weight in the range of about 700 to 2,200, and more preferably, in the range of about 900 to 1,500. The hydrocarbyl group may be either straight chain or branched chain. Preferably, the hydrocarbyl group will be a branched chain hydrocarbyl group.

When employing a branched chain hydrocarbyl-substituted succinimide, the branched chain hydrocarbyl group is preferably derived from polymers of $C_2$ to $C_6$ olefins. Such branched chain hydrocarbyl groups are described more fully above in the discussion of hydrocarbyl-substituted amines and hydroxyalkyl-substituted amines. Preferably, the branched chain hydrocarbyl group will be derived from polypropylene or polyisobutylene. More preferably, the branched chain hydrocarbyl group will be derived from polyisobutylene.

The succinimides employed in the present invention are prepared by reacting a straight or branched chain hydrocarbyl-substituted succinic acid or anhydride with a polyamine having from 2 to about 12 amine nitrogen atoms and 2 to about 40 carbon atoms.

Hydrocarbyl-substituted succinic anhydrides are well known in the art and are prepared by the thermal reaction of olefins and maleic anhydride as described, for example, in U.S. Pat. Nos. 3,361,673 and 3,676,089. Alternatively, hydrocarbyl-substituted succinic anhydrides can be prepared by reaction of chlorinated olefins with maleic anhydride as described, for example, in U.S. Pat. No. 3,172,892. The olefin employed in these reactions has a number average molecular weight in the range of about 250 to about 3,000. Preferably, the number average molecular weight of the olefin is about 700 to about 2,200, more preferably about 900 to 1,500.

The reaction of a polyamine with an alkenyl or alkyl succinic acid or anhydride to produce a polyamino alkenyl or alkyl succinimide is well known in the art and is described, for example, in U.S. Pat. Nos. 3,018,291; 3,024,237; 3,172,892; 3,219,666; 3,223,495; 3,272,746; 3,361,673 and 3,443,918.

The Amine Component of the Succinimide

The amine moiety of the hydrocarbyl-substituted succinimide is preferably derived from a polyamine having from 2 to about 12 amine nitrogen atoms and from 2 to about 40 carbon atoms. The polyamine is preferably reacted with a hydrocarbyl-substituted succinic acid or anhydride to produce the hydrocarbyl-substituted succinimide fuel additive finding use within the scope of the present invention. The polyamine, encompassing diamines, provides the product succinimide with, on the average, at least about one basic nitrogen atom per succinimide molecule, i.e., a nitrogen atom titratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The polyamine component employed in the present invention has been described and exemplified more fully in U.S. Pat. No. 4,191,537.

Hydrocarbyl, as used in describing the amine components used in this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The more preferred polyamine finding use within the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylene triamine, triethylene tetramine, di(trimethylene) triamine, dipropylene triamine, tetraethylene pentamine, etc. Among the polyalkylene polyamines, polyethylene polyamine and polypropylene polyamine containing 2–12 amine nitrogen atoms and 2–24 carbon atoms are especially preferred and in particular, the lower polyalkylene polyamines, e.g., ethylenediamine, diethylene triamine, propylene diamine, dipropylene triamine, etc., are most preferred. Particularly preferred polyamines are ethylene diamine and diethylene triamine.

The Polyalkyl Hydroxyaromatic Compound

As noted above, the polyalkyl hydroxyaromatic component of the present fuel additive composition is a polyalkyl hydroxyaromatic compound or salt thereof wherein the polyalkyl group has sufficient molecular weight and carbon chain length to render the polyalkyl hydroxyaromatic compound soluble in hydrocarbons boiling in the gasoline or diesel range. As with the aliphatic amine component of the present invention, the polyalkyl hydroxyaromatic compound will preferably be of sufficient molecular weight so as to be nonvolatile at normal engine intake valve operating temperatures, generally in the range of about 175° C. to 300° C.

In general, the polyalkyl substituent on the polyalkyl hydroxyaromatic compound will have an average molecular weight in the range of about 400 to 5,000, preferably about 400 to 3,000, more preferably from about 600 to 2,000.

The polyalkyl-substituted hydroxyaromatic compounds finding use in this invention are derived from hydroxyaromatic hydrocarbons. Such hydroxyaromatic compounds include mononuclear monohydroxy and polyhydroxy aromatic hydrocarbons having 1 to 4, and preferably 1 to 3, hydroxy groups. Suitable hydroxyaromatic compounds include phenol, catechol, resorcinol, hydroquinone, pyrogallol, and the like. The preferred hydroxyaromatic compound is phenol.

Suitable polyalkyl hydroxyaromatic compounds and their preparation are described, for example, in U.S. Pat. Nos. 3,849,085; 4,231,759 and 4,238,628, the disclosures of each of which are incorporated herein by reference.

The polyalkyl substituent on the polyalkyl hydroxyaromatic compounds employed in the invention may be generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl hydroxyaromatic compounds are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 30, a polyisobutene having a molecular weight of about 1300 and a methylvinylidene content of about 74%, available from British Petroleum.

Numerous methods are known for preparing the polyalkyl hydroxyaromatic compounds used in the present invention and any of these are considered suitable for producing the polyalkyl hydroxyaromatic component of the instant fuel additive composition. One such method involves the reaction of a phenol with an olefin polymer in the presence of an aluminum chloride-sulfuric acid catalyst, as described in U.S. Pat. No. 3,849,085. Similarly, U.S. Pat. No. 4,231,759 discloses that polyalkyl hydroxyaromatic compounds may be obtained by the alkylation of phenol with polypropylene, polybutylene and other polyalkylene compounds, in the presence of an alkylation catalyst, such as boron trifluoride.

One preferred method of preparing polyalkyl hydroxyaromatic compounds is disclosed in U.S. Pat. No. 4,238,628. This patent teaches a process for producing undegraded alkylated phenols by alkylating, at about 0° C. to 60° C., a complex comprising boron trifluoride and phenol with a propylene or higher olefin polymer having terminal ethylene units, wherein the molar ratio of complex to olefin polymer is about 1:1 to 3:1. Preferred olefin polymers include polybutene having terminal ethylene units.

Preferred polyalkyl hydroxyaromatic compounds finding use in the fuel additive composition of the present invention include polypropylene phenol, polyisobutylene phenol, and polyalkyl phenols derived from polyalphaolefins, particularly 1-decene oligomers.

Polyalkyl phenols, wherein the polyalkyl group is derived from polyalphaolefins, such as 1-octene and 1-decene oligomers, are described in PCT International Patent Application Publication No. WO 90/07564, published Jul. 12, 1990, the disclosure of which is incorporated herein by reference. This publication teaches that such polyalkyl phenols may be prepared by reacting the appropriate polyalphaolefin with phenol in the presence of an alkylating catalyst at a temperature of from about 60° C. to 200° C., either neat or in an inert solvent at atmospheric pressure. A preferred alkylation catalyst for this reaction is a sulfonic acid catalyst, such as Amberlyst 15®, available from Rohm and Haas, Philadelphia, Pa.

Also contemplated for use in the present fuel additive composition are the salts of the polyalkyl hydroxyaromatic component, such as alkali metal, alkaline earth metal, ammonium, substituted ammonium and sulfonium salts. Preferred salts are the alkali metal salts of the polyalkyl hydroxyaromatic compound, particularly the sodium and potassium salts, and the substituted ammonium salts.

Fuel Compositions

The fuel additive composition of the present invention will generally be employed in a hydrocarbon distillate fuel boiling in the gasoline or diesel range. The proper concentration of this additive composition necessary in order to achieve the desired detergency and dispersancy varies depending upon the type of fuel employed, the presence of other detergents, dispersants and other additives, etc. Generally, however, from 150 to 7500 weight ppm, preferably from 300 to 2500 ppm, of the present additive composition per part of base fuel is needed to achieve the best results.

In terms of individual components, fuel compositions containing the additive compositions of the invention will generally contain about 50 to 2500 ppm of the aliphatic amine and about 100 to 5000 ppm of the polyalkyl hydroxyaromatic compound. The ratio of polyalkyl hydroxyaromatic to aliphatic amine will generally range from about 0.5 to 10:1, and will preferably be about 2:1 or greater.

The deposit control additive may be formulated as a concentrate, using an inert stable oleophilic organic solvent boiling in the range of about 150° F. to 400° F. Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the detergent-dispersant additive. In the concentrate, the amount of the present additive composition will be ordinarily at least 10% by weight and generally not exceed 70% by weight, preferably 10 to 50 weight percent and most preferably from 10 to 25 weight percent.

In gasoline fuels, other fuel additives may also be included such as antiknock agents, e.g., methylcyclopentadienyl manganese tricarbonyl, tetramethyl or tetraethyl lead, or other dispersants or detergents such as various substituted amines, etc. Also included may be lead scavengers such as aryl halides, e.g., dichlorobenzene or alkyl halides, e.g., ethylene dibromide. Additionally, antioxidants, metal deactivators, pour point depressants, corrosion inhibitors and demulsifiers may be present.

In diesel fuels, other well-known additives can be employed, such as pour point depressants, flow improvers, cetane improvers, and the like.

The following examples are presented to illustrate specific embodiments of this invention and are not to be construed in any way as limiting the scope of the invention.

EXAMPLES

Example 1

Preparation of Polyisobutyl Phenol

To a flask equipped with a magnetic stirrer, reflux condenser, thermometer, addition funnel and nitrogen inlet was added 203.2 grams of phenol. The phenol was warmed to 40° C. and the heat source was removed. Then, 73.5 milliliters of boron trifluoride etherate was added dropwise. 1040 grams of Ultravis 10polyisobutene (molecular weight 950, 76% methylvinylidene, available from British Petroleum) was dissolved in 1,863 milliliters of hexane. The polyisobutene was added to the reaction at a rate to maintain the temperature between 22°–27° C. The reaction mixture was stirred for 16 hours at room temperature. Then, 400 milliliters of concentrated ammonium hydroxide was added followed by 2,000 milliliters of hexane. The reaction mixture was washed with water (3×2,000 milliliters), dried over magnesium sulfate, filtered and the solvents removed under vacuum to yield 1,056.5 grams of a crude reaction product. The crude reaction product was determined to contain 80% of the desired product by proton NMR and chromatography on silica gel eluting with hexane, followed by hexane: ethylacetate: ethanol (93:5:2).

Example 2

Engine Test

A laboratory engine test was used to evaluate both intake valve and combustion chamber deposit performance of the additive composition of the invention. The test engine is a 4.3 liter, TBI (throttle body injected), V6 engine manufactured by General Motors Corporation.

The major engine dimensions are listed below:

TABLE I

| Engine Dimensions | |
|---|---|
| Bore | 10.16 cm |
| Stroke | 8.84 cm |
| Displacement Volume | 4.3 liter |
| Compression Ratio | 9.3:1 |

The test procedure involves engine operation for 40 hours (24 hours a day) on a prescribed load and speed schedule representative of typical driving conditions. The cycle for engine operation during the test is as follows:

TABLE II

Engine Driving Cycle

| Step | Mode | Time in Mode [Sec]* | Dynamometer Load [kg] | Engine Speed [RPM] |
|---|---|---|---|---|
| 1 | Idle | 60 | 0 | 800 |
| 2 | City Cruise | 150 | 10 | 1,500 |
| 3 | Acceleration | 40 | 25 | 2,800 |
| 4 | Heavy HWY Cruise | 210 | 15 | 2,200 |
| 5 | Light HWY Cruise | 60 | 10 | 2,200 |
| 6 | Idle | 60 | 0 | 800 |
| 7 | City Cruise | 180 | 10 | 1,500 |
| 8 | Idle | 60 | 0 | 800 |

*All steps except step number 3, include a 15 second transition ramp. Step 3 include a 20 second transition ramp.

All of the test runs were made with the same base gasoline, which was representative of commercial unleaded fuel. The results are set forth in Table III.

TABLE III

Laboratory Engine Test Results

| Additive | Concentration, ppm | | Intake Valve Deposits, mg | Combustion Chamber Deposits, mg |
|---|---|---|---|---|
| Base Fuel | — | Run 1 | 530 | 1,455 |
| | | Run 2 | 510 | 1,341 |
| | | Avg. | 520 | 1,398 |
| Amine/Neutral Oil[a] | 200/800 | Run 1 | 203 | 2,585 |
| | | Run 2 | 224 | 2,565 |
| | | Avg. | 214 | 2,575 |
| Polyalkyl Phenol[b] | 400 | Run 1 | 90 | 2,190 |
| | | Run 2 | 104 | 2,534 |
| | | Avg. | 97 | 2,362 |
| Amine/Polyalkyl Phenol[c] | 200/400 | Run 1. | 25 | 2,228 |
| | | Run 2 | 67 | 2,121 |
| | | Avg. | 46 | 2,175 |

[a]Mixture of 200 ppm polyisobutyl (MW = 1300) ethylene diamine and 800 ppm of Chevron 500 R neutral oil. The polyisobutyl group was derived from Parapol 1300 polyisobutene.
[b]Ultravis 10 polyisobutyl (MW = 950) phenol.
[c]Mixture of 200 ppm polyisobutyl (MW = 1300) ethylene diamine and 400 ppm of Ultravis 10 polyisobutyl (MW = 950) phenol.

The results shown in Table III demonstrate that the combination of polyisobutyl phenol and polyisobutyl ethylene diamine has a synergistic effect and gives significantly better intake valve deposit control than either component by itself. Also, the addition of polyisobutyl phenol to the polyisobutyl ethylene diamine reduces the combustion chamber deposit weight compared to the polyisobutyl ethylene diamine alone.

What is claimed is:

1. A fuel additive composition comprising:

(a) a fuel-soluble branched chain hydrocarbyl-substituted amine having at least one basic nitrogen atom, wherein the hydrocarbyl group is derived from polyisobutylene and has a number average molecular weight of about 900 to 1,500 and the amine moiety is derived from a polyalkylene polyamine selected from the group consisting of ethylene diamine, and diethylene triamine; and (b) a polyalkyl phenol or salt thereof wherein the polyalkyl group is derived from polyisobutylene and has an average molecular weight of about 600 to 2,000; and wherein the ratio of polyalkyl phenol to hydrocarbyl-substituted amine is in the range of about 2:1 to 10:1.

2. The fuel additive composition according to claim 1, wherein the polyisobutylene employed in component (b) contains at least about 20% of a methylvinylidene isomer.

3. A fuel composition comprising a major amount of hydrocarbons boiling in the gasoline or diesel range and an effective detergent amount of an additive composition comprising:

(a) a fuel-soluble branched chain hydrocarbyl-substituted amine having at least one basic nitrogen atom, wherein the hydrocarbyl group is derived from polyisobutylene and has a number average molecular weight of about 700 to 2,200 and the amine moiety is derived from a polyalkylene polyamine selected from the group consisting of and, diethylene triamine, triethylene tetramine, and (b) a polyalkyl phenol or salt thereof wherein the polyalkyl group is derived from polyisobutylene and has an average molecular weight of about 600 to 2,000; and wherein the ratio of polyalkyl phenol to hydrocarbyl-substituted amine is in the range of about 2:1 to 10:1.

4. A fuel concentrate comprising an inert stable oleophilic organic solvent boiling in the range of from about 150° F. to 400° F. and from about 10 to 70 weight percent of an additive composition comprising:

(a) a fuel-soluble branched chain hydrocarbyl-substituted amine having at least one basic nitrogen atom, wherein the hydrocarbyl group is derived from polyisobutylene and has a number average molecular weight of about 900 to 1,500 and the amine moiety is derived from a polyalkylene polyamine selected from the group consisting of ethylene diamine, and diethylene triamine, and (b) a polyalkyl phenol or salt thereof wherein the polyalkyl group is derived from polyisobutylene and has an average molecular weight of about 600 to 2,000; and wherein the ratio of polyalkyl phenol to hydrocarbyl-substituted amine is in the range of about 2:1 to 10:1.

* * * * *

UNITED STATES PATENT AND TRADEMARK OFFICE

CERTIFICATE OF CORRECTION

PATENT NO : 5,755,835

DATED : May 26, 1998

INVENTOR(S): Richard E. Cherpeck

It is certified that error appears in the above-identified patent and that said Letters Patent is hereby corrected as shown below:

Claim 3, lines 11-12 thereof, the expression

"and, diethylene triamine, triethylene tetramine,"

should read --ethylene diamine and diethylene triamine;--.

Signed and Sealed this

Ninth Day of February, 1999

*Attest:*

*Attesting Officer*

*Acting Commissioner of Patents and Trademarks*